United States Patent [19]

Penfound

[11] Patent Number: 4,476,220

[45] Date of Patent: Oct. 9, 1984

[54] SPECTRALLY SENSITIZED PHOTOTHERMOGRAPHIC MATERIALS AND PREPARATION THEREOF

[75] Inventor: Keith A. Penfound, Saffron Walden, England

[73] Assignee: Minnesota Mining and Manufacturing Company, Saint Paul, Minn.

[21] Appl. No.: 510,068

[22] Filed: Jul. 1, 1983

[30] Foreign Application Priority Data

Jul. 29, 1982 [GB] United Kingdom ..... 8221958

[51] Int. Cl.[3] ..... G03C 1/02; G03C 1/00

[52] U.S. Cl. ..... 430/569; 430/570; 430/619; 430/620

[58] Field of Search ..... 430/619, 620, 570, 569

[56] References Cited

U.S. PATENT DOCUMENTS

| | | | |
|---|---|---|---|
| 2,735,766 | 2/1956 | Hill | 95/7 |
| 3,628,960 | 12/1971 | Philippaerts | 430/571 |
| 3,666,477 | 5/1972 | Goffe | 430/619 |
| 3,719,495 | 3/1973 | Lea | 96/114.1 |
| 3,871,887 | 3/1975 | Jones | 96/67 |
| 4,105,451 | 8/1978 | Smith et al. | 96/66 T |
| 4,123,282 | 10/1978 | Winslow | 430/619 |
| 4,128,557 | 12/1978 | Knight et al. | 430/619 |
| 4,161,408 | 7/1979 | Winslow et al. | 430/569 |
| 4,173,478 | 11/1979 | Holstead et al. | 430/353 |
| 4,183,756 | 1/1980 | Locker | 430/569 |
| 4,225,666 | 9/1980 | Locker et al. | 430/569 |

OTHER PUBLICATIONS

Research Disclosure, Dec. 1971, vol. 92, pp. 107–110, #9232.

Research Disclosure, Jun. 1978, No. 170, pp. 9–15, #17029.

Research Disclosure, No. 19227.

*Primary Examiner*—Mary F. Downey

*Attorney, Agent, or Firm*—Donald M. Sell; James A. Smith; Mark A. Litman

[57] ABSTRACT

Photothermographic emulsions display enhanced spectral sensitization when the silver halide grains are formed in the presence of one or more spectral sensitizing dyes.

20 Claims, No Drawings

SPECTRALLY SENSITIZED PHOTOTHERMOGRAPHIC MATERIALS AND PREPARATION THEREOF

BACKGROUND OF THE INVENTION

1. Field of the Invention

This invention relates to spectrally sensitized photothermographic materials of the dry silver type and to their preparation.

2. Prior Art

Photothermographic materials of the dry silver type comprise a light-insensitive silver source material, usually a silver salt of a long chain fatty acid; e.g., silver behenate, as the heat sensitive component and a silver halide as the light sensitive component. The silver halide may be prepared in situ by conversion of a portion of silver soap by reaction with halide ions or it may be preformed and added during soap preparation.

Dry silver materials are generally sensitized by the addition of spectral sensitizing dyes prior to coating the silver halide/silver soap mixture on a support. Suitable dyes include the cyanine type sensitizers, well known in the spectral sensitization technology of conventional silver halide systems, and merocyanine type sensitizers as disclosed, for example, in U.S. Pat. Nos. 3,719,495 and 3,716,279 and U.K. Pat. No. 1,466,201. The dyes are generally added in solution to the silver halide/silver soap mixture. This is an inefficient method of sensitizing due to the fact that much of the sensitizing dye is adsorbed by the non-light sensitive silver soap, thus enabling only a proportion of the dye added to be adsorbed by the light-sensitive silver halide. Accordingly, large concentrations of dye must be used in order to ensure the adsorption to the silver halide of the required proportion of dye. The necessity for such large amounts of dye in the silver halide/silver soap mixture has limited the number of suitable dyes, mainly to merocyanines, since many known spectral sensitizing dyes will not heat bleach effectively at high concentrations thereby causing background staining of the material.

In the case of dry silver materials having a preformed silver halide component, an alternative method of spectral sensitization comprises treating the silver halide with the sensitizing dye prior to mixing with the silver soap. An example of this technique is disclosed in U.S. Pat. No. 4,105,451 in which light sensitive silver halide is spectrally sensitized before addition to the heat sensitive silver salt of a heterocyclic thione. The spectral sensitization of the preformed silver halide suffers from the disadvantage that the dye becomes easily desorbed from the silver halide surface during the silver soap preparation and the homogenization stages, where large variations in temperature, pressure, pH and the addition of solvents are encountered. This results in the sensitizing effect in the dry silver material becoming diminished or in some cases completely destroyed.

The technique of preparing silver halide emulsions in the presence of a sensitizing dye is known for use in conventional silver halide systems. U.S. Pat. No. 2,735,766 discloses blending a spectral sensitizing dye of the merocyanine type with either the silver salt or the halide salt prior to mixing these two salts to form silver halide. U.S. Pat. No. 4,225,666 discloses introducing a sensitizing dye into the reaction vessel after the nucleation of the silver halide grains has occurred and before the silver halide preparation is completed. Neither of these references disclose the use of such spectrally sensitized silver halide emulsions in photothermographic materials.

Research Disclosure No. 19,227 generally discloses techniques for preparing silver halide emulsions. This reference states that the grain growth or crystal habit modifiers, metal dopants or species capable of creating internal sensitivity centers and/or spectral sensitizing dyes, desensitizing dyes or desensitizing organic compounds (electron acceptors) can be present in the reaction vessel or the reactant(s) stream(s) prior to initiation of nucleation, during nucleation, after nucleation is complete, throughout the entire precipitation or just prior to completion of precipitation. This reference further states that silver halide emulsions prepared in the presence of grain growth or crystal habit modifiers, metal dopants or species capable of creating dyes, desensitizing dyes or desensitizing organic compounds (electron acceptors) can be used in color, color transfer, black-and-white negative, graphic arts, photothermographic, cine positive, cine negative, documentary and recording, and radiographic materials, etc. However, there is no experimental data to substantiate any of the statements made nor any disclosure of a specific photothermographic material in this reference.

Heretofore, the range of sensitizing dyes used in photothermographic materials has been limited for the reasons discussed above. In particular, J-banding cyanine dyes which have been used extensively in conventional silver halide systems have not been used effectively in photothermographic materials with the exception of anhydro-9-ethyl-3,3′-di(3-sulphopropyl)-4,5;4′,5′-dibenzothiacarbocyanine hydroxide sodium salt which is disclosed in U.S. Pat. No. 3,871,887 in a photothermographic material in the presence of lithium iodide which is said to promote J-aggregation.

It is an object of the present invention to provide a process for preparing spectrally sensitized photothermographic materials in which a wide range of spectral sensitizing dyes may be used, including J-banding dyes, and to provide photothermographic materials incorporating a wide range of spectral sensitizing dyes including J-banding dyes.

BRIEF DESCRIPTION OF THE INVENTION

According to one aspect of the invention, there is provided a process for preparing a photothermographic material which comprises forming a dispersion of a long chain fatty acid in water maintained at a temperature above the melting point of the acid, converting the acid to an ammonium or alkali metal salt of the acid, cooling the dispersion and converting said salt of the acid to a silver salt, in which silver halide grains are added to the dispersion of the acid, to the ammonium or alkali metal salt thereof, or to said silver salt; characterized in that the silver halide grains are spectrally sensitized silver halide grains obtained by forming silver halide grains in the presence of one or more spectral sensitizing dyes.

According to a second aspect of the invention there is provided a photothermographic material which comprises spectrally sensitized silver halide and a silver salt of a long chain fatty acid in which the silver halide was formed in the presence of one or more spectral sensitizing dyes.

According to a further aspect of the invention there is provided a photothermographic material which comprises spectrally sensitized silver halide and a silver salt of a long chain fatty acid in which the silver halide is spectrally sensitized with one or more dyes in a J-aggregate state in the absence of lithium iodide.

DETAILED DESCRIPTION OF THE INVENTION

It has been found that the formation of silver halide crystals in the presence of any spectral sensitizing dye results in a much improved dyeing efficiency of the silver halide when it is used in the preparation of dry silver material. It is believed that the sensitizing dye is much more strongly adsorbed to the silver halide than when the dye is added to the preformed silver halide, and this strong adsorption is sufficient to withstand the rigors of the soap preparation and homogenization, and thus the dye remains adsorbed to the silver halide in the resulting dry silver material. As a result of this increased efficiency, it is possible to use smaller concentrations of dyes to achieve optimum sensitization, and this means that the heat bleaching ability of dyes is not so critical. Thus, it is possible, in accordance with the invention, to use dyes which were not acceptable previously due to the fact that high concentrations were needed for optimum sensitization and the poor heat bleaching of these dyes resulted in staining. These dyes may now be used in such low concentrations to attain optimum sensitization that their poor heat bleaching ability is no longer a critical factor and stain-free images may be produced. In particular, it is possible to use a wide range of cyanine and merocyanine dyes including J-banding dyes.

The phenomenon of J-banding and J-aggregation is described, for example, in *The Theroy Of The Photographic Process,* C. E. K. Mees, T. H. James, 3rd Ed., pages 214ff, 245ff and 254ff. J-banding dyes have been used extensively in conventional silver halide systems as highly efficient sensitizing dyes but have given poor sensitizing effects in dry silver systems when applied by the conventional dyeing methods. The process of the invention allows such dyes to be incorporated in dry silver systems in a manner which allows J-aggregation of the dyes thereby allowing optimum sensitization to be achieved.

The spectral sensitizing dyes may be added at any time before the emulsification time of the silver halide has elapsed. Thus, the dyes may be introduced into the reaction vessel before or after nucleation of the silver halide grains has occurred. The silver halide may comprise any of the conventional light sensitive halides; e.g., silver bromide, silver iodobromide, silver chloride, silver iodide or silver bromochloride. Chemical sensitization with metal salts and sulphur containing compounds may also be used. The concentration of dye used varies according to the particular dye and is generally in the range from 0.05 to 5.0 g/mole of silver halide, preferably 0.1 to 0.8 g/mole of silver halide. It has been found that the concentration of dye may be substantially reduced; e.g., tenfold, in accordance with the invention compared to prior dyeing processes in dry silver systems and still provide comparable or even superior sensitivity.

The heat-sensitive component used in the invention may be any of the silver salts of long chain fatty acids conventionally used. Preferably, the long chain fatty acid comprises an alkyl group of 14 to 28 carbon atoms having a terminal carboxylic acid group, more preferably the acid comprises behenic acid.

The silver source material should be present as about 25 to 70 percent by weight of the imaging layer. The use of a two-layer construction would not affect the percentage of the silver source material desired in the imaging layer.

The silver halide is generally present as 0.75 to 15 percent by weight of the imaging layer, although larger amounts up to 20 or 25 percent are useful. It is preferred to use from 1 to 10 percent by weight of silver halide in the imaging layer and most preferred to use from 1.5 to 7.0 percent.

The reducing agent for silver ion may be any material, preferably organic material, which will reduce silver ion to metallic silver. Conventional photographic developers such as phenidone, hydroquinones, and catechol are useful, but hindered phenol reducing agents are preferred. The reducing agent should be present as 1 to 10 percent by weight of the imaging layer. In a two-layer construction, if the reducing agent is in the second layer, slightly higher proportions, of from about 2 to 15 percent tend to be more desirable.

Toners such as phthalazinone, phthalazine and phthalic acid are not essential to the construction, but are highly desirable. These materials may be present, for example, in amounts of from 0.2 to 5 percent by weight.

The binder may be selected from any of the well-known natural and synthetic resins.

The spectrally sensitized silver halide grains may be incorporated into a photothermographic material during its preparation by any of the conventional techniques. Thus, spectrally sensitized silver halide may be added to the long chain fatty acid dispersion, to the ammonium or alkali metal salt of the long chain fatty acid, or to the silver salt of the long chain fatty acid. The spectrally sensitized silver halide may be added in a single batch or in two or more stages. The addition may take place during formation of the ammonium or alkali metal salt or during formation of the silver salt if desired. In each case good sensitization is obtained. The spectrally sensitized silver halide may be used in combination with full soap formulations (i.e., 100% silver salt of the acid) or in partial soap formulations; e.g., half soap formulations (approximately 50/50 mole percent of silver salt/fatty acid).

The silver halide is useful in concentrations of 0.25 to 75% by weight of total silver, but preferably is used in amounts of 1 to 50% and most preferably from 2 to 25% of the total weight of silver in the soap.

The combined light sensitive and heat sensitive emulsion may be coated on a substrate in accordance with conventional techniques to provide a photothermographic element. Preferably, the emulsion is coated with an organic reducing agent for silver ions, a toner and a binder. A further sensitizing dye may be added to the emulsion prior to coating.

The invention will now be illustrated by the following Examples.

EXAMPLE 1

This Example illustrates a general technique for preparing photothermographic materials in accordance with the invention.

The preformed silver halide emulsions prepared in the presence of sensitizing dye will hereinafter be referred to as S.E.S. emulsions (simultaneous emulsification and sensitization emulsions).

(A) Silver Halide Preparation

The emulsions were prepared by a 15 minute double-jet emulsification. The emulsions were 6% iodobromides and ranged in size from 0.2 to 0.23μ. The dye was added to the reaction vessel as a separate jet over a seven minute period. The starting time of the dye jet relative to the start of the emulsification can be varied.

| | | 1 mole | |
|---|---|---|---|
| A @ 45° C. | gelatin | 25 g | |
| | $NH_4OH$ (3.0 N) | 20 ml | |
| | water (distilled) | to 1500 ml | |
| | | | Jet B and C into A in 15 minutes |
| B @ 45° C. | KBr | 112 g | |
| | KI | 9.92 g | |
| | water (distilled) | to 750 ml | |
| C @ 20° C. | $AgNO_3$ (2.5 N) | 400 ml | |
| | water (distilled) | 350 ml | |
| D @ 20° C. | sensitizing dye dissolved in 50 ml MeOH + 200 ml water | | Jet D into A During mixing of B and C |
| E | Teepol 610* | 15 ml | Add E, lower pH with 1 N $H_2SO_4$ to 3.5. Cool with stirring to 25° C. |
| F | Industrial methylated spirit | 20 ml | Stand and pour off |
| | water (distilled) | 20 ml | Wash twice with cold tap water. Redisperse in F at 45° C. |
| G | gelatin | 10 g | Add G and stir for 15 minutes at 45° C. |
| | water | 10 ml | |
| H | phenol (20% solution in 1:1 ethanol:water) | 10 ml | Add H, stir and chill. |

*Teepol 610 is a sodium salt of a secondary alkyl sulphate commercially available from Shell Chemicals UK Ltd. The S.E.S. preformed emulsion was then used in the preparation of a silver soap. Both full soaps and half soaps (i.e., 100% silver behenate and 50% silver behenate/50% behenic acid, respectively) may be prepared by this technique. The preparation of a full silver soap is described below.

(B) Soap Preparation 1. 80 g behenic acid was melted in 2000 ml distilled water at 80° C. and vigorously stirred.
2. 0.05 mole of S.E.S. preformed emulsion was added. The resulting mixture was stirred for 1 minute.
3. 9.6 g NaOH in 500 ml distilled water was added and the mixture stirred for 10 minutes.
4. 0.5 ml concentrated $HNO_3$ in 5 ml of distilled water was added.
5. The mixture was cooled to 45° to 50° C. with vigorous stirring.
6. 39.5 g $AgNO_3$ in 400 ml distilled water was added slowly over 5 minutes, thereupon the thinned mixture was stirred for 10 minutes.
7. Mixture heated to 80° C. and filtered hot.
8. Solid washed twice with cold distilled water.
9. Placed in oven and dried for seven days at 32° C.

(C) Homogenization

The dried powder was dispersed in solvents, 100 g powder in 995 ml methyl ethyl ketone and 405 ml toluene. The mixture was homogenized by passing twice through a Gaulin homogenizer.

(D) Coating 100 g homogenate
10.5 g Butvar B-76 (a polyvinyl butyral commercially available from Monsanto Company Ltd.)
0.67 ml mercuric bromide (10% solution in MeOH)
1.9 g Nonox WSO [1,1-bis(2'-hydroxy-3',5'-dimethylphenyl)-3,5,5-trimethylhexane commercially available from I.C.I. Ltd.]
0.2 g phthalazine
0.27 g 4-methyl phthalic acid.

The above composition was coated on a polyester base on a knife coater at 0.075 or 0.1 mm wet thickness (silver coating weight approximately 1.5 g/m$^2$.

A top coating comprising:
200 ml methyl ethyl ketone
95 ml toluene
11 ml MeOh
8.6 g vinyl acetate/vinyl chloride copolymer (type VYNS commercially available from Union Carbide Corp.)
was applied over the first trip at 0.05 mm wet thickness.

EXAMPLE 2

The spectral sensitizing dye used in this Example was a green sensitizer of the formula:

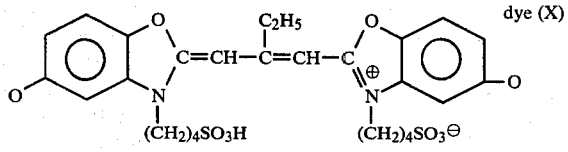

Photothermographic elements incorporating S.E.S. emulsions were prepared as in Example 1 with a range of dye concentrations from 0.05 to 0.5 g dye (X)/mole of silver halide. Hereinafter in the interests of brevity the dye concentration will simply be expressed in g/mole, the mole referring to the silver halide content. It was found that dye (X) concentrations greater than 0.3 g/mole are required to give good dry silver sensitization.

EXAMPLE 3

(I) A dry silver film incorporating an S.E.S. preformed emulsion was prepared with 0.4 g of dye (X)/mole of silver halide as in Example 1, with the exception that the dye jet was started 5 minutes after the start of the emulsification.

(II) As a comparison, an undyed standard 6% silver iodobromide preformed emulsion was sensitized with 0.4 g of dye (X)/mole and then used in the preparation of a standard dry silver film as above.

(III) A further comparison was made by preparing a dry silver film containing undyed 6% iodobromide preformed emulsion and adding 4.0 g of dye (X)/mole at coating.

The three films were exposed on a wedge spectrograph and heat developed at 126° C. in a fluorocarbon bath. Film (I) exhibited a very intense J-band at 550 nm, films (II) and (III) showed only a weak peak at 550 nm. Furthermore, film (III) had a significant pink stain after processing whereas films (I) and (II) were stain free.

The three films were also exposed through a narrow waveband filter transmitting light of 551 nm. The sensitivities of the films are given below as the exposure in ergs/cm$^2$ required to give a density of 1.0.

| Film | ergs/cm$^2$ at 551 nm to give D = 1.0 |
|---|---|
| (I) | 8 |
| (II) | 110 |

-continued

| Film | ergs/cm$^2$ at 551 nm to give D = 1.0 |
|---|---|
| (III) | 191 |

The results show the superior sensitizing efficiency of the S.E.S. technique (I) requiring ten times less dye than (III) to produce a higher sensitivity and exhibiting a fourteen-fold improvement in sensitivity over (II).

The two preformed S.E.S. emulsions used in films (I) and (II) were coated as gelatin emulsions on a polyester base and the resulting films (IV and V, respectively) were exposed to light of 551 nm and wet-developed in a conventional silver halide developer. The following sensitivities were obtained.

| Film | ergs/cm$^2$ at 551 nm to give D = 1.0 |
|---|---|
| (IV) | 15 |
| (V) | 48 |

This result shows that the S.E.S. preformed emulsion is three times faster than the standard emulsion in the silver halide form. However, when these two emulsions are incorporated into the dry silver film the speed difference is now 14 times. This demonstrates that while the S.E.S. technique may give a small benefit in the silver halide form, the real and unexpected advantage of the technique is found when the emulsion is incorporated into the dry silver form.

EXAMPLE 4

This Example demonstrates that the starting time of the dye addition does not appear to be too critical provided the dye addition is complete before the emulsificatime has elapsed. An S.E.S. emulsion was prepared as in Example 2 with the exception that the dye addition was started at the same time as the $Ag^{\oplus}$ and $Br^{\ominus}$ additions (i.e., at the start of emulsification). This emulsion was used in a dry silver film (VI). The results obtained for sensitivity at 551 nm are shown below.

| Film | ergs/cm$^2$ at 551 nm to give D = 1.0 |
|---|---|
| (VI) Dye (X) added at start of emulsification | 10 |
| (I) Dye (X) added 5 minutes after start of emulsification | 8 |

EXAMPLE 5

The sensitizing dye used in this Example was:

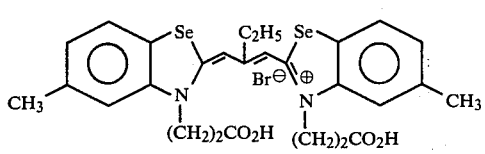

dye (Y)

A 6% iodobromide of grain size 0.2$\mu$ was prepared with 0.4 g of dye (Y)/mole of silver halide as in Example 1 except that the start of the dye addition was made 5 minutes after the start of the silver halide emulsification. A dry silver film (VII) was prepared incorporating this emulsion as in Example 1.

A dry silver film (VIII) was also prepared by adding 3.6 g dye (Y)/mole at coating to a dry silver material containing a standard undyed preformed 6% iodobromide emulsion of 0.2$\mu$. The two films were exposed on a wedge spectrometer and heat developed. The resulting wedge spectra showed that film (VII) had produced sensitivity peaks at 630 and 660 nm with sensitivity up to 700 nm, whereas film (VIII) had a peak at 610 nm and sensitivity reaching ony 660 nm. Narrow waveband exposures at 640 nm were made and the results were as follows:

| Film | ergs/cm$^2$ at 640 nm to give D = 1.0 |
|---|---|
| (VII) | 18 |
| (VIII) | 138 |

This is another example of J-banding being achieved in the dry silver state by means of the S.E.S. technique. J-banding with dye (Y) is possible in the silver halide state, but is only possible in the dry silver state when the S.E.S. technique is used. No J-banding occurs when the dye is added at coating to the silver halide/silver behenate mixture.

EXAMPLE 6

This Example employed a merocyanine (non-J-banding) dye of the formula:

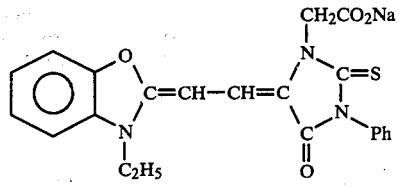

dye (Z)

0.15 g of the dye (Z)/mole was added in the preparation of an S.E.S. emulsion (6% iodobromide of 0.2$\mu$) as in Example 1 with the dye addition starting 1 minute after the start of the silver halide emulsification. The resultant emulsion was used in the preparation of a dry silver film (IX). This film was compared with a dry silver film (X) prepared by dyeing at coating with 2.0 g dye (Z)/mole a standard undyed preformed emulsion/soap. A further film (XI) was prepared by addition of a 0.6 g dye (Z)/mole of silver halide to a silver halide/silver behenate emulsion containing the silver halide used in film (IX). The films were exposed to a tungsten light exposure of a 1000 meter candle seconds and the relative log speeds were read at a density of 0.1 above $D_{min}$. Heat development was at 126° C. in a fluorocarbon bath.

| Film | Relative Log Speed |
|---|---|
| (IX) | 2.25 |
| (X) | 2.20 |
| (XI) | 2.46 |

To obtain the same sensitivity only 0.15 g dye (Z)/mole is required for an S.E.S. emulsion soap (XI) gives a further 0.2 log E increase in sensitivity.

EXAMPLE 7

Variation in Full Soap Making Procedures

The preformed S.E.S. silver halide emulsion employed in this Example was prepared according to the following procedure.

| | | |
|---|---|---|
| 1 mole A | gelatin | 25 g |
| @ | water (distilled) | 1500 ml pH to 4.0 with $HNO_3$ |
| 50° C. | $AgNO_3$ (2.5 N) | 6 ml |
| B | KBr | 140 g |
| @ | KI | 12.4 g |
| 50° C. | water (distilled) | to 937.5 ml |
| C | $AgNO_3$ (2.5 N) | 400 ml |
| @ 20° C. | water (distilled) | 350 ml |
| D @ 20° C. | sensitizing dye dissolved in 250 ml of methanol | |

Solution B was pumped at a constant 50 ml/minute into Solution A and Solution C pumped at a sufficient rate to maintain the pAg constant throughout the make, the pumps for Solutions B and C being started simultaneously. When the addition of Solution C was completed, the addition of Solution B was continued until the emulsion was in halide excess.

Solution D was pumped at 25 ml/minute into Solution A, the pump being started 2 minutes after the start of the emulsification.

The resulting solution was cooled to 25° C. with stirring and Solution E added:

10% solution in water of an anionic surfactant sodium lauryl sulphate available under the trade name Maprofix from Millmaster-Onyx UK. 150 ml The pH was adjusted to 3.6 with 1N $H_2SO_4$. The mixture was allowed to settle and the supernatant liquid poured off. The coagulum was washed once with cold distilled water, allowed to settle and poured off and then redispersed in Solution F at 50° C. for 30 minutes.

| | |
|---|---|
| water (distilled) | 100 ml |
| gelatin | 10 g |
| industrial methylated spirit | 50 ml |
| NaOH 1 N | 20 ml |

Solution G was then added before chilling.

G phenol (20% solution in 1 : 1 ethanol : water) 20 ml

The spectral sensitizing dye used for this emulsion was dye (X), at a concentration of 0.8 g/mole of silver halide. The average grain diameter of the emulsion was 0.09μ. Three full soaps were made using the basic soap preparation set out in Example 1, except for the following variations:

| | |
|---|---|
| (XII) | as Example 1 |
| (XIII) | S.E.S. preformed emulsion added after stage 3; i.e., after sodium behenate formation |
| (XIV) | S.E.S. preformed emulsion added after stage 6; i.e., after silver behenate formation |

The homogenization and coating procedures used were as in Example 1. Wedge spectra of these films showed that a J-band at 550 nm had been formed in all three cases, but film (XIV) had an increased spectral response in the region between 470 and 530 nm.

The three films were exposed through a narrow waveband filter transmitting light of 551 nm and heat developed on a curved heated blanket at 126° C. The sensitivities of the films are given below:

| Film | ergs/cm$^2$ at 551 nm to give D = 1.0 |
|---|---|
| (XII) | 72 |
| (XIII) | 58 |
| (XIV) | 30 |

A significant increase in sensitivity was shown by film (XIV) over (XII) and (XIII), although the contrast of this film was lower than for the other two coatings. This Example shows that the S.E.S. technique can be used successfully by a number of different full soap preparation procedures.

EXAMPLE 8

Half-Soap Formulations (i.e., approximately 50/50 mole % of silver behenate/behenic acid)

The S.E.S. preformed emulsion described in Example 7 was used in the preparation of three half-soaps according to the following procedures.

Sample (XV)

(1) 150 g of behenic acid was melted in 1600 ml of distilled water at 85° C. and vigorously stirred.
(2) 9.17 g of NaOH in 100 mls of distilled water was added, and the mixture stirred for 10 minutes.
(3) 0.05 mole of S.E.S. preformed emulsion was added, and the mixture stirred for 1 minute.
(4) 38.5 g of $AgNO_3$ in 250 ml of distilled water at a temperature of 85° C. was added slowly over 30 minutes.
(5) The mixture was cooled to room temperature with stirring and then filtered.
(6) The solid was washed twice with cold distilled water.
(7) The solid was placed in an oven and dried for 7 days at 32° C.

Sample (XVI)

The above procedure was used except that the S.E.S. preformed emulsion was added before stage (2), i.e., before sodium behenate formation.

Sample (XVII)

(1) 160 g of behenic acid was melted in 800 ml of distilled water at 82° C. and vigorously stirred.
(2) 9.47 g of NaOH in 50 ml of distilled water was added slowly under vigorous stirring.
(3) 2.4 liters of cold distilled water was added and the temperature of the mixture brought to 40° C.
(4) 0.05 mole of S.E.S. preformed emulsion at 40° C. was added and stirred for five minutes.
(5) 39.44 g of $AgNO_3$ in 200 ml of distilled water was added slowly and the mixture vigorously stirred for 10 minutes after the $AgNO_3$ addition.
(6) The mixture was then cooled to room temperature and stood for 90 minutes.
(7) The mixture was then filtered and the solid washed three times with cold distilled water.
(8) Solid dried in an oven for 7 days at 32° C.

Homogenization (common to all three half-soap samples)

The dried powder was dispersed in solvent by mixing 100 g of powder with 623 ml of acetone and stirring for 3 hours at room temperature. A further 313 ml of acetone was added and then stirred for 30 minutes. The mixture was homogenized by passing it twice through a Gaulin homogenizer.

Coating

The coating solution comprised 66.4 g of homogenate+20 g toluene (mixed 15 minutes)+0.05 g Butvar B-76 (mixed 10 minutes)+0.25 ml mercuric bromide (10% solution in MeOH) (mixed 10 minutes)+11.4 g Butvar B-76 (mixed 30 minutes)+0.5 ml mercuric bromide (10% solution in MeOH) (mixed 15 minutes)+2.0 g Nonox WSO (mixed 10 minutes)+0.2 g phthalazine+0.27 g 4-methyl phthalic acid (mixed 10 minutes).

The above composition was coated onto a paper base by a knife coater at 0.075 mm wet thickness (silver coating weight approximately 1.0 g/m$^2$). The same topcoat as described in Example 1 was applied over the first trip at 0.05 mm wet thickness.

The three coatings were exposed on a wedge spectrograph and heat developed at 126° C. on a curved heated blanket. All three coatings showed similar spectral responses with intense J-bands at 550 nm. The sensitivities to a narrow band exposure at 551 nm were as follows:

| Film | ergs/cm$^2$ at 551 nm to give D = 1.0 |
|---|---|
| (XV) | 42 |
| (XVI) | 21 |
| (XVII) | 31 |

This Example demonstrates the successful application of the S.E.S. technique to various half-soap formulations.

EXAMPLE 9

The following dyes were used successfully to prepare spectrally sensitized dry silver films using the S.E.S. preformed emulsion and full soap procedures as in Example 1. Wedge spectrographs were prepared by these films and the results are given in the following Table.

TABLE

| Dye structure | Optimum dye concentration g/mole silver halide | Spectral Response sensitivity range | Spectral Response peak location |
|---|---|---|---|
| 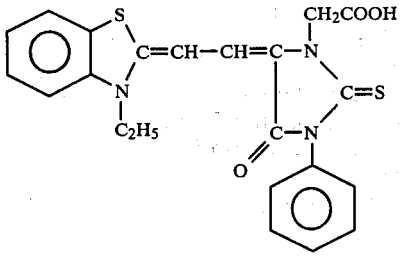 | 0.15 | 490 to 630 nm | 530, 570 nm |
| 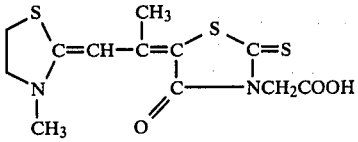 | 0.15 | 490 to 570 nm | 550 nm |
| 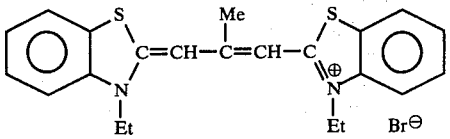 | 0.4 | 490 to 620 nm | 530, 600 nm |
| 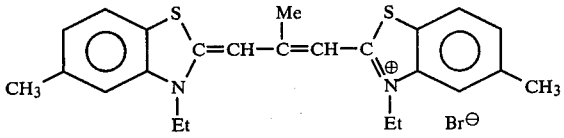 | 0.4 | 490 to 630 nm | 530, 600 nm |
| 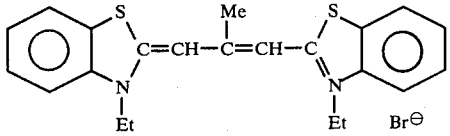 | 0.4 | 490 to 620 nm | 530, 600 nm |

TABLE-continued

| Dye structure | Optimum dye concentration g/mole silver halide | Spectral Response sensitivity range | Spectral Response peak location |
|---|---|---|---|
| * 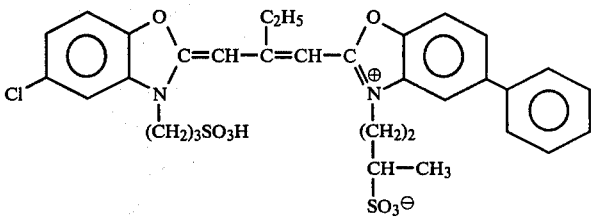 | 0.8 | 490 to 560 nm | 550 nm ** |
| 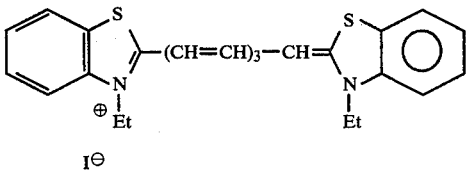 I⊖ | 0.5 | Approx. 650 *** to *** 870 nm | Approx. 810 nm |

* Uses S.E.S. preformed emulsion described in Example 7
** Sensitivity due to J-band at 551 n, of 309 ergs/cm$^2$ to give density = 1.0
*** Spectral response estimated. Sensitive to laser diode emission ca. 813 nm.

I claim:

1. A process for preparing a photothermographic material which comprises:
   forming a dispersion of a long chain fatty acid in water maintained at a temperature above the melting point of the acid,
   converting at least part of the acid to an ammonium or alkali metal salt of the acid, and
   converting said salt of the acid to a silver salt,
   in which silver halide grains are added to the dispersion of the acid, to the ammonium or alkali metal salt thereof, or to said silver salt, characterized in that the silver halide grains are spectrally sensitized silver halide grains obtained by forming silver halide grains in the presence of one or more spectral sensitizing dyes.

2. A process as claimed in claim 1, characterized in that spectral sensitizing dye is present at the start of emulsification of the silver halide.

3. A process as claimed in claim 1, characterized in that spectral sensitizing dye is added after emulsification of the silver halide has begun but before completion of emulsification.

4. A process as claimed in claim 1, characterized in that the spectral sensitizing dye is a cyanine or merocyanine dye.

5. A process as claimed in claim 2, characterized in that the spectral sensitizing dye is a cyanine or merocyanine dye.

6. A process as claimed in claim 3, characterized in that the spectral sensitizing dye is a cyanine or merocyanine dye.

7. A process as claimed in claim 1, characterized in that the spectral sensitizing dye is a J-banding dye.

8. A process as claimed in claim 3, characterized in that the spectral sensitizing dye is a J-banding dye.

9. A process as claimed in claim 4, characterized in that the spectral sensitizing dye is a J-banding dye.

10. A process as claimed in claim 6, characterized in that the spectral sensitizing dye is a J-banding dye.

11. The process of claim 1, characterized in that further sensitizing dye is added after the silver halide has formed.

12. The process of claim 1, characterized in that the spectrally sensitized silver halide grains are added to the dispersion of a long chain fatty acid.

13. The process of claim 4, characterized in that the spectrally sensitized silver halide grains are added to the dispersion of a long chain fatty acid.

14. The process of claim 1, characterized in that the spectrally sensitized silver halide grains are added to the ammonium or alkali metal salt of the long chain fatty acid.

15. The process of claim 7, characterized in that the spectrally sensitized silver halide grains are added to the silver salt of the long chain fatty acid.

16. The process of claim 1, characterized in that the emulsion of silver halide and silver salt of the acid is coated on a substrate with an organic reducing agent for silver ions, a toner and a binder.

17. A photothermographic material which comprises spectrally sensitized silver halide and a silver salt of a long chain fatty acid, characterized in that the silver halide was preformed in the presence of one or more spectral sensitizing dyes.

18. A photothermographic material as claimed in claim 17, characterized in that the spectral sensitizing dye is a cyanine or merocyanine dye.

19. A photothermographic material as claimed in claim 18, characterized in that the spectral sensitizing dye is a J-banding dye.

20. A photothermographic material which comprises spectrally sensitized silver halide and a silver salt of a long chain fatty acid, characterized in that the silver halide is spectrally sensitized with a dye in a J-aggregate state in the absence of lithium iodide.

* * * * *